US006889497B2

(12) United States Patent
Schnaibel et al.

(10) Patent No.: US 6,889,497 B2
(45) Date of Patent: May 10, 2005

(54) METHOD AND CONTROLLER FOR OPERATING A NITROGEN OXIDE (NOX) STORAGE CATALYST

(75) Inventors: Eberhard Schnaibel, Hemmingen (DE); Klaus Winkler, Rutesheim (DE)

(73) Assignee: Robert Bosch GmbH, Stuttgart (DE)

( * ) Notice: Subject to any disclaimer, the term of this patent is extended or adjusted under 35 U.S.C. 154(b) by 119 days.

(21) Appl. No.: 10/333,954

(22) PCT Filed: Jul. 11, 2001

(86) PCT No.: PCT/DE01/02594

§ 371 (c)(1),
(2), (4) Date: Jan. 27, 2003

(87) PCT Pub. No.: WO02/08582

PCT Pub. Date: Jan. 31, 2002

(65) Prior Publication Data

US 2003/0163987 A1 Sep. 4, 2003

(30) Foreign Application Priority Data

Jul. 26, 2000 (DE) ..... 100 36 453

(51) Int. Cl.[7] ..... F01N 3/00

(52) U.S. Cl. ..... 60/285; 60/274; 60/276; 701/103

(58) Field of Search ..... 60/274, 276, 277, 60/285, 295, 297; 701/103, 109

(56) References Cited

U.S. PATENT DOCUMENTS 5,735,119 A * 4/1998 Asanuma et al. ..... 60/276
6,308,515 B1 * 10/2001 Bidner et al. ..... 60/274
6,327,848 B1 * 12/2001 Poggio et al. ..... 60/276
6,385,966 B2 5/2002 Zhang
6,389,802 B1 5/2002 Berger et al.
6,438,947 B2 * 8/2002 Ludwig et al. ..... 60/285
6,460,329 B2 * 10/2002 Shimotani et al. ..... 60/285
6,497,092 B1 * 12/2002 Theis ..... 60/274
6,546,718 B2 * 4/2003 Hepburn et al. ..... 60/276
6,594,989 B1 * 7/2003 Hepburn et al. ..... 60/286

FOREIGN PATENT DOCUMENTS

| | | | |
|---|---|---|---|
| DE | 198 23 921 | 12/1999 | |
| DE | 198 23 923 | 12/1999 | |
| DE | 198 28 928 | 1/2000 | |
| EP | 0 867 604 | 9/1998 | |
| EP | 0 997 626 | 5/2000 | |
| EP | 1083306 A1 * | 3/2001 | ..... F01N/3/08 |
| FR | 2 798 425 | 3/2001 | |

* cited by examiner

*Primary Examiner*—Tu M. Nguyen
(74) *Attorney, Agent, or Firm*—Walter Ottesen

(57) ABSTRACT

A method for operating a nitrogen oxide (NOx) storage catalytic converter (12') of an internal combustion engine (1) includes storing nitrogen oxides (NOx), which are generated by the engine (1), in a first operating phase in the NOx storage catalytic converter (12'). In a second operating phase, nitrogen oxides stored in the NOx storage catalytic converter (12') are discharged from the NOx storage catalytic converter (12'). The start of the second operating phase is determined based on a nitrogen oxide (NOx) fill level (mnosp) of the NOx storage catalytic converter (12') and the NOx fill level (mnosp) is modeled based on a nitrogen oxide (NOx) storing model (30). To be able to precisely and reliably determine the start and the end of the second operating phase, a first value of the nitrogen oxide (NOx) mass flow (msnonk_s) rearward of the NOx storage catalytic converter (12') is detected and the NOx storing model (30) is corrected in dependence upon the detected first value.

8 Claims, 2 Drawing Sheets

METHOD AND CONTROLLER FOR OPERATING A NITROGEN OXIDE (NOX) STORAGE CATALYST

FIELD OF THE INVENTION

The present invention relates to a method for operating a nitrogen oxide (NOx) storage catalytic converter of an internal combustion engine, especially of a motor vehicle. In a first operating phase, nitrogen oxides, which are generated by the engine, are stored in the storage catalytic converter and, in a second operating phase, the nitrogen oxides, which are stored in the storage catalytic converter, are discharged from the storage catalytic converter. The start of the second operating phase is determined based on a nitrogen oxide (NOx) fill level of the NOx storage catalytic converter. The NOx fill level is modeled based on a nitrogen oxide (NOx) storing model.

The invention further relates to a control apparatus for an internal combustion engine, especially of a motor vehicle. The engine can be switched back and forth by the control apparatus between a first operating phase wherein the nitrogen oxides, which are generated by the engine, are stored in the nitrogen oxide (NOx) storage catalytic converter and a second phase, wherein stored nitrogen oxides are discharged from the NOx storage catalytic converter. The control apparatus includes first means for determining the start of the second operating phase based on a nitrogen oxide (NOx) fill level of the NOx storage catalytic converter which is modeled by means of a nitrogen oxide (NOx) storing model. Furthermore, the present invention relates to a control element, especially a read-only-memory or a flash memory, for a control apparatus of this kind.

Finally, the present invention relates to an internal combustion engine, especially of a motor vehicle. The internal combustion engine includes a control apparatus and a nitrogen oxide (NOx) storage catalytic converter. The engine can be switched back and forth by the control apparatus between a first operating phase wherein nitrogen oxides, which are generated by the engine, are stored in the NOx storage catalytic converter and a second operating phase wherein the stored nitrogen oxides are discharged from the NOx storage catalytic converter. The internal combustion engine includes first means for determining the start of the second operating phase based on a nitrogen oxide (NOx) fill level of the NOx storage catalytic converter which is modeled by means of a nitrogen oxide (NOx) storing model.

BACKGROUND OF THE INVENTION

In internal combustion engines, which can be operated with a lean air/fuel mixture (lambda>1), nitrogen oxide (NOx) storage catalytic converters are used in order to store the nitrogen oxide (NOx) emissions which are discharged by the engine during a first operating phase. This first operating phase of the NOx storage catalytic converter is also characterized as the storing phase. With increasing duration of the storing phase, the efficiency of the NOx storage catalytic converter falls off, which leads to an increase of the NOx emissions rearward of the NOx storage catalytic converter. The cause for this reduction of efficiency lies in the increase of the nitrogen oxide (NOx) fill level of the NOx storage catalytic converter. The NOx fill level can be monitored and the second operating phase of the NOx catalytic converter (discharge phase) can be initiated after a pregiven threshold value is exceeded. A nitrogen oxide (NOx) storing model can be used for determining the NOx fill level of the NOx storage catalytic converter.

During the second operating phase, a reducing agent is added to the exhaust gas of the internal combustion engine which reduces the stored nitrogen oxides to nitrogen and oxygen. Hydrocarbon (HC) and/or carbon monoxide (CO) can be used, for example, as a reducing agent. This reducing agent can be generated by a rich adjustment of the air/fuel mixture in the exhaust gas. Alternatively, urea can be added to the exhaust gas as a reducing agent. Here, ammonia from the urea is used for reducing the nitrogen oxide to oxygen and nitrogen. The ammonia can be obtained by hydrolysis from a urea solution.

Toward the end of the discharge phase, a large portion of the stored nitrogen oxide is reduced and less and less of the reducing agent comes together with nitrogen oxide, which it can reduce to oxygen and nitrogen. As a consequence, the portion of the reducing agent in the exhaust gas rearward of the NOx storage catalytic converter increases toward the end of the discharge phase and the portion of oxygen in the exhaust gas rearward of the NOx storage catalytic converter becomes less. From an analysis of the exhaust gas rearward of the NOx storage catalytic converter by suitable exhaust-gas sensors, the end of the discharge phase can be initiated when the largest portion of the nitrogen oxide has been discharged from the NOx storage catalytic converter.

In an NOx storing model, which is known from the state of the art, the NOx fill level of the NOx storage catalytic converter can be determined in dependence upon, inter alia, the NOx mass flow forward of the NOx storage catalytic converter, the NOx mass flow rearward of the NOx storage catalytic converter and the temperature of the NOx storage catalytic converter. From these variables, an efficiency of the NOx storage catalytic converter is determined. This efficiency is multiplied by the NOx mass flow forward of the NOx storage catalytic converter and is integrated to supply the actual NOx fill level. The second operating phase is initiated as soon as the NOx fill level exceeds the pregivable threshold value. For constant boundary conditions, the efficiency of the NOx storage catalytic converter decreases with increasing fill level.

SUMMARY OF THE INVENTION

The present invention has as its basis the task to determine the NOx fill level of an NOx storage catalytic converter reliably and as precisely as possible with the aid of an NOx storing model and therewith the start and end of the second operating phase (discharge phase) in order to ensure an optimal exhaust-gas quality).

To solve this task, the invention starts with the method of the kind initially mentioned herein in that a first value of the nitrogen oxide (NOx) mass flow rearward of the NOx storage catalytic converter is detected and the NOx storing model is corrected in dependence upon the detected first value.

According to the invention, it is therefore suggested that the NOx storing model is corrected utilizing a measured value. From the measured value, a corrective factor for the NOx storing model can be obtained, which can be applied for diagnostic purposes. With the measured value of the NOx fill level, the NOx fill level, which is modeled with the aid of the NOx storing model, can be corrected and therefore the start and end of the second operating phase can be determined with significantly higher accuracy. This, in turn, permits an operation at the limit of the storage capacity of the NOx storage catalytic converter, that is, the storage capability of the NOx store is fully utilized without the storage capability being exceeded, which leads to a clearly improved exhaust-gas quality. With the aid of the method of the invention, the NOx storing model and/or the start and end of the second operating phase can be adapted to the actual emissions of the engine.

According to an advantageous further embodiment of the present invention, it is suggested that the first value of the NOx mass flow rearward of the NOx storage catalytic converter is measured by means of an NOx sensor.

According to a preferred embodiment of the present invention, it is suggested that a second value of the NOx mass flow rearward of the NOx storage catalytic converter is taken from the NOx storing model and the NOx storing model is corrected in dependence upon the two values of the NOx mass flow.

Advantageously, a difference of the two values of the NOx mass flows is formed and the NOx storing model is corrected in dependence upon the difference.

Advantageously, the NOx fill level is determined in the NOx storing model by integrating the product of the NOx mass flow forward of the NOx storage catalytic converter and an efficiency of the NOx storage catalytic converter. The efficiency of the NOx storage catalytic converter is determined, for example, in dependence upon the NOx mass flow forward of the NOx storage catalytic converter and from the temperature of the NOx storage catalytic converter.

According to a further preferred embodiment of the present invention, it is suggested that the difference of the two values of the NOx mass flow behind the NOx storage catalytic converter is supplied to a controller and the NOx storing model is corrected in dependence upon an actuating variable of the controller. The controller is preferably configured as an integrating I-controller. The output signal of the NOx sensor, which is mounted after the NOx storage catalytic converter, is therefore not directly evaluated (for example, via the absolute value, the slope or the like); instead, the output signal serves to control the NOx storing model by means of the I-controller.

Finally, it is suggested that the NOx storing model is corrected in dependence upon the efficiency of the NOx storage catalytic converter as the actuating variable of the controller.

Of special significance is the realization of the method of the invention in the form of a control element, which is provided for a control apparatus of an internal combustion engine, especially of a motor vehicle. A program is stored on the control element, which can be run on a computing apparatus and especially on a microprocessor and is suitable for carrying out the method of the invention. In this case, the invention is therefore realized by a program stored on the control element so that this control element, which is provided with the program, defines the invention in the same way as the method which the program can execute. As a control element, especially an electric storage medium can be used, for example, a read-only-memory or a flash memory.

As a further solution of the task of the present invention, it is suggested starting with the control apparatus of the type mentioned initially herein that the control apparatus includes second means for detecting a first value of the nitrogen oxide (NOx) mass flow rearward of the NOx storage catalytic converter and third means for correcting the NOx storing model in dependence upon the detected first value.

Finally, for solving the task of the present invention and starting from the internal combustion engine of the kind mentioned initially herein, it is suggested that the engine include second means for detecting a first value of the nitrogen oxide (NOx) mass flow rearward of the NOx storage catalytic converter and third means for correcting the NOx storing model in dependence upon the detected first value.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
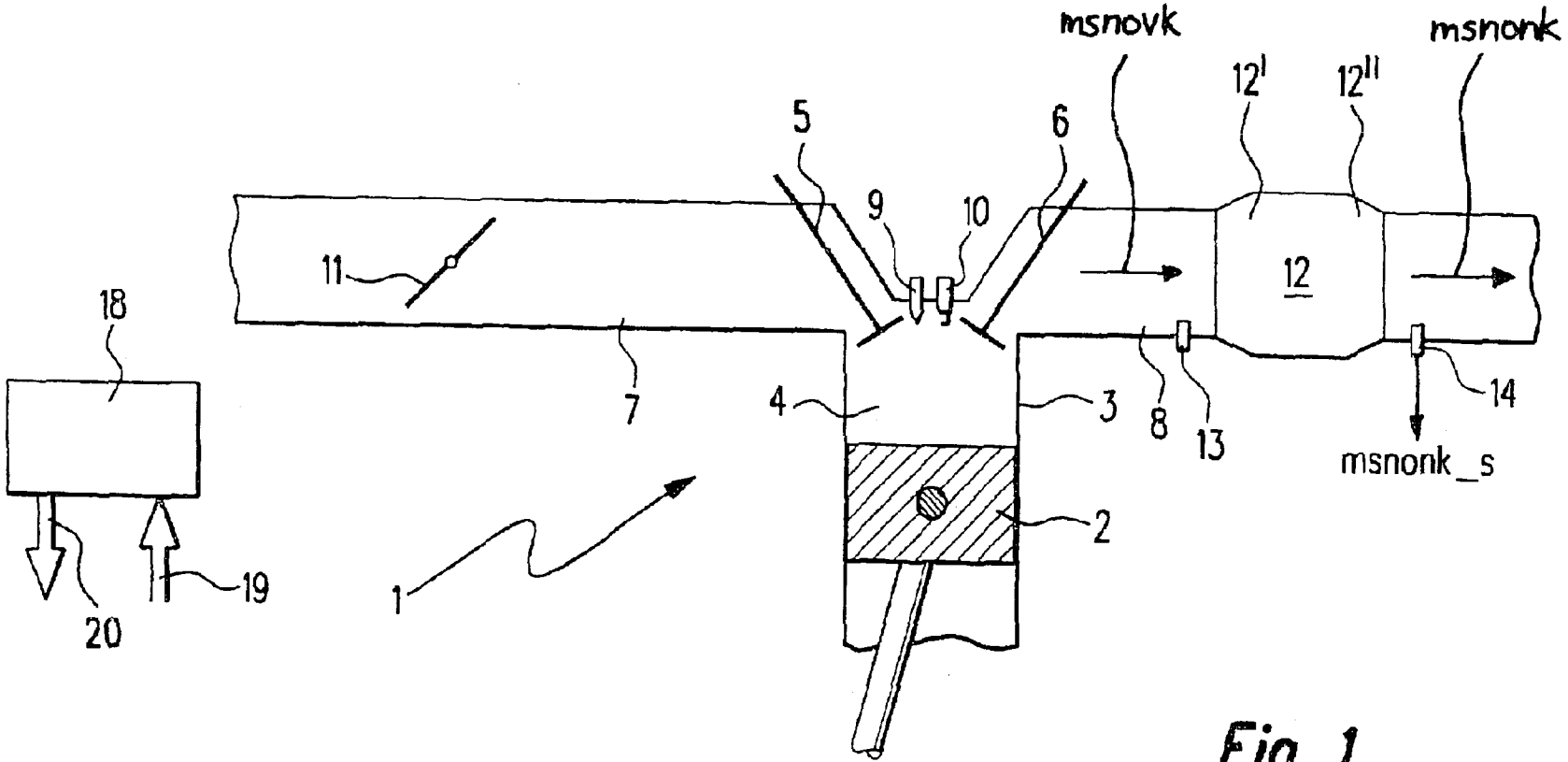
FIG. 1 is a schematic block circuit diagram of an internal combustion engine of the invention in accordance with a preferred embodiment thereof.

In FIG. 1, a direct-injecting internal combustion engine 1 is shown wherein a piston 2 is movable back and forth in a cylinder 3. The cylinder 3 is provided with a combustion chamber 4 which, inter alia, is delimited by the piston 2, an inlet valve 5 and an outlet valve 6. An intake manifold 7 is coupled to the inlet valve 5 and an exhaust-gas pipe 8 is coupled to the outlet valve 6.

A fuel-injection valve 9 and a spark plug 10 project into the combustion chamber 4 in the region of the inlet valve 5 and of the outlet valve 6. Fuel can be injected into the combustion chamber 4 via the injection valve 9. The fuel in the combustion chamber 4 can be ignited by the spark plug 10.

A rotatable throttle flap 11 is mounted in the intake manifold 7. Air is supplied via the throttle flap 11 to the intake manifold 7. The quantity of the supplied air is dependent upon the angular position of the throttle flap 11. A catalytic converter 12 is accommodated in the exhaust-gas pipe 8 and cleans the exhaust gases arising from the combustion of the fuel. The catalytic converter 12 is a nitrogen oxide NOx storage catalytic converter 12' which is coupled to a 3-directional catalytic converter 12" as an oxygen store.

Input signals 19 are applied to a control apparatus 18 and define operating variables of the engine 1 which are measured by means of sensors. The control apparatus 18 generates output signals 20 which can influence the performance of the engine 1 via actuators or positioning devices. The control apparatus 18 is, inter alia, provided for controlling (open loop and/or closed loop) operating variables of the engine 1. For this purpose, the control apparatus 18 is provided with a microprocessor which has a program stored in a storage medium, especially, in a flash memory. The program is suitable to carry out the above-mentioned control (open loop and/or closed loop).

In a first operating mode, a so-called homogeneous operation of the engine 1, the throttle flap 11 is partially opened or closed in dependence upon the desired torque. The fuel is injected into the combustion chamber 4 during an induction phase caused by the piston 2. The injected fuel is swirled by the air inducted simultaneously via the throttle flap 11 and is essentially uniformly distributed in the combustion chamber 4. Thereafter, the air/fuel mixture is compressed during the compression phase in order to be ignited by the spark plug 10. The piston 2 is driven by the expansion of the ignited fuel. In homogeneous operation, the arising torque is dependent, inter alia, on the position of the throttle flap 11. The air/fuel mixture is adjusted as close to lambda=1 as possible with a view to a low development of toxic substances.

In a second mode of operation, a so-called stratified operation of the engine 1, the throttle flap 11 is opened wide. The fuel is injected into the combustion chamber 4 by the injection valve 9 during a compression phase caused by the piston 2 and the fuel is injected locally in the direct vicinity of the spark plug 10 as well as at a suitable distance in time ahead of the ignition time point. The fuel is then ignited with the aid of the spark plug 10 so that the piston 2 is driven in the following work phase by the expansion of the ignited fuel. In stratified operation, the arising torque is dependent substantially on the injected fuel mass. The stratified operation is essentially provided for the idle operation and the part-load operation of the engine 1. Lambda is usually >1 in stratified operation.

During a first operating phase, the engine 1 is driven in stratified operation and the storage catalytic converter 12' is loaded with nitrogen oxides and the 3-way catalytic converter 12" is loaded with oxygen (storing phase). In a second operating phase (regeneration phase), the storage catalytic converter 12' and the 3-way catalytic converter 12" are again discharged so that they can again take up nitrogen oxides and oxygen, respectively, in the next stratified operation (discharge phase). A reduction agent is added to the exhaust gas ahead of the catalytic converter 12 during the regeneration phase. Hydrocarbons (HC), carbon monoxide (CO) or urea are examples of reducing agents which can be used. Hydrocarbons and carbon monoxide are generated in the exhaust gas via a rich mixture adjustment (operation of the internal combustion engine in homogeneous operation). Urea can be controllably metered to the exhaust gas from a supply vessel. The following processes take place during the regeneration phase of the catalytic converter 12: the reducing agent reduces the stored nitrogen oxides to nitrogen and oxygen. These substances leave the catalytic converter 12 so that an oxygen excess results behind the catalytic converter 12 during the regeneration phase even though the engine 1 is driven with a rich air/fuel mixture (oxygen deficiency).

An oxygen (O2) sensor 13 is mounted ahead of the catalytic converter 12 and a nitrogen oxide (NOx) sensor 14 is mounted in the exhaust-gas pipe 8 after the catalytic converter 12. After a switchover to oxygen deficiency (operation of the engine 1 with a rich mixture) forward of the catalytic converter 12 at the start of the regeneration phase, the O2 sensor 13 reacts virtually without delay. The oxygen storage locations of the catalytic converter 12 are at first almost all occupied because of the oxygen excess in the exhaust gas which is present during the stratified operation. After the switchover to oxygen deficiency at the start of the regeneration phase, the oxygen storage locations are successively liberated of oxygen which then exits from the catalytic converter 12. Accordingly, behind the catalytic converter 12, there is at first a further oxygen excess after the switchover into the regeneration phase. After a time span, which depends upon the oxygen storage capability of the catalytic converter 12, the total nitrogen oxide, which is stored in the storage catalytic converter 12', is reduced and the total oxygen, which is stored in the oxygen store 12", is removed so that an oxygen deficiency occurs also rearward of the catalytic converter 12.

Figure 2:
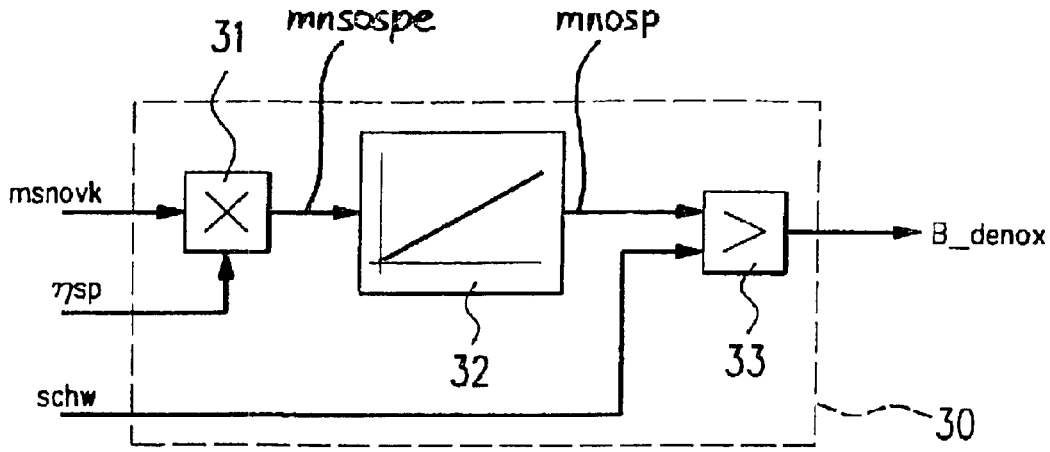
FIG. 2 is a schematic signal flow plan of an NOx storing model.

An NOx storing model is schematically shown in FIG. 2. The NOx mass flow msnovk ahead of the catalytic converter 12 and an efficiency eta_sp of the NOx storage catalytic converter 12' are supplied as input quantities to the NOx storing model 30. The efficiency eta_sp is determined in dependence upon, inter alia, the NOx mass flow msnovk ahead of the NOx storage catalytic converter 12', an NOx mass flow msnonk rearward of the NOx storage catalytic converter 12' and the temperature of the NOx storage catalytic converter 12'. The efficiency eta_sp is a non-linear function of the NOx fill level mnosp of the NOx storage catalytic converter 12' and decreases with increasing NOx fill level.

A product mnsospe of the NOx mass flow msnovk and the efficiency eta_sp is formed in a multiplier 31. The product mnsospe is integrated in an integrator 32. As an output signal, the integrator 32 supplies the NOx fill level mnosp of the NOx storage catalytic converter 12'. This fill level is compared to a pregivable threshold value schw in a comparator 33. If the NOx fill level mnosp exceeds the threshold value schw, the regeneration phase of the NOx storage catalytic converter 12' is initiated by means of a regeneration signal B_denox.

Figure 3:
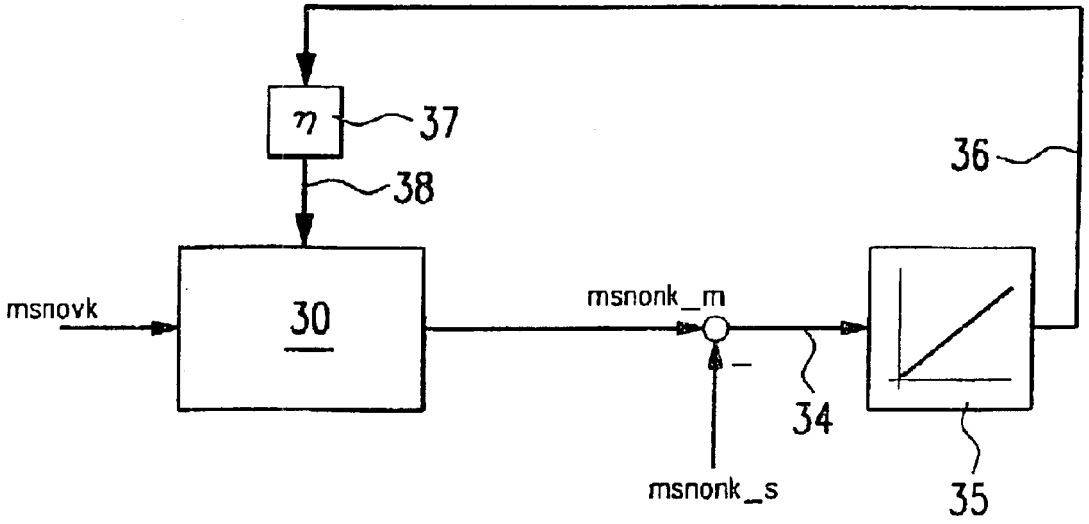
FIG. 3 is a schematic signal flow plan of a method of the invention in accordance with a preferred embodiment.

In FIG. 3, a method according to the invention is schematically shown. In the method, an output signal msnonk_s of the NOx sensor 14 functions to control the NOx storing model 30. The NOx sensor 14 is mounted rearward of the catalytic converter 12. In this way, the start and the end of the second operating phase (regeneration phase) of the NOx storage catalytic converter 12' can be determined with significantly greater accuracy and reliability, which leads to a clear improvement of the exhaust-gas quality.

A modeled NOx mass flow msnonk_m is modeled downstream of the catalytic converter 12. The modeled NOx mass flow msnonk_m results from the difference of the NOx mass flow msnovk ahead of the catalytic converter 12 and the product of the NOx mass flow msnovk and the efficiency eta_sp, that is, from msnovk·(1−eta_sp). The NOx mass flow msnovk ahead of the catalytic converter 12 can be measured by an NOx sensor (not shown) or can be taken from the NOx model.

A control difference 34 of the control loop shown in FIG. 3 is formed from the difference of the modeled NOx mass flow msnonk_m after the catalytic converter 12 and the NOx mass flow msnonk_s after the catalytic converter 12 with the NOx mass flow being measured by the NOx sensor 14. The control difference 34 is supplied to an integrating I-controller 35. Any other desired suitable controller can be used in lieu of an I-controller 35.

An actuating variable 36 of the I-controller 35 is conducted to an actuating member 37 which varies an actuating variable 38 in order to operate on the NOx storing model 30 in a controlled and targeted manner. The efficiency eta_sp of the NOx storage catalytic converter 12' is applied as an actuating variable 38.

What is claimed is:

1. A method for operating a nitrogen oxide (NOx)-storage catalytic converter of an internal combustion engine including an internal combustion engine of a motor vehicle, the engine generating nitrogen oxides (NOx) and the method comprising the steps of:

storing the nitrogen oxides generated by said engine during a first operating phase in said (NOx)-storage catalytic converter;

discharging the nitrogen oxides stored in said NOx-storage catalytic converter in a second operating phase;

detecting a first value of an (NOx) mass flow (msnonk_s) rearward of said (NOx)-storage catalytic converter;

taking a second value of said (NOx) mass flow (msnonk_m) rearward of said NOx-storage catalytic converter from an NOx storing model;

forming a difference of said first and second values of said NOx mass flows ( msnok_m−msnonk_s);

correcting said NOx storing model in dependence upon said difference (msnonk_m−msnonk_s);

modeling an NOx fill level (mnosp) of said NOx storage catalytic converter based on said (NOx) storing model; and determining the start of said second operating phase based on said (NOx) fill level (mnosp) of said NOx-storage catalytic converter.

2. The method of claim 1, wherein said NOx fill level (mnosp) is determined in said NOx storing model by integrating the product of the NOx mass flow (msnovk) ahead of said NOx-storage catalytic converter and an efficiency (eta_sp) of said NOx-storage catalytic converter.

3. The method of claim 1, wherein said first value of the NOx mass flow (msnonk_s) rearward of said NOx storage catalytic converter is measured by an NOx sensor.

4. The method of claim 1, wherein said difference (msnonk_m−msnonk_s) of said first and second values (msnonk_s, msnonk_m) is supplied to a controller and said NOx storing model is corrected in dependence upon an actuating variable of said controller.

5. The method of claim 4, wherein said NOx storing model is corrected in dependence upon the efficiency (eta_sp) of said NOx-storage catalytic converter as the actuating variable of said controller.

6. A control element, including a read-only-memory or a flash memory, for a control apparatus of an internal combustion engine including an internal combustion engine of a motor vehicle, the control element comprising a program stored thereon which can be run on a computing apparatus including a microprocessor, and said program being suitable for carrying out a method for operating a nitrogen oxide (NOx)-storage catalytic converter of an internal combustion engine including an internal combustion engine of a motor vehicle, the engine generating nitrogen oxides (NOx) and the method including the steps of:

storing the nitrogen oxides generated by said engine during a first operating phase in said (NOx)-storage catalytic converter;

discharging the nitrogen oxides stored in said NOx-storage catalytic converter in a second operating phase;

detecting a first value of an (NOx) mass flow (msnonk_s) rearward of said (NOx)-storage catalytic converter;

taking a second value of said NOx-storage catalytic converter from an NOx storing model;

forming a difference of said first and second values of said NOx mass flow (msnonk_m−msnonk_s);

correcting said NOx storing model in dependence upon said difference (msnonk_m−msnonk_s);

modeling an NOx fill level (mnosp) of said NOx-storage catalytic converter based on said (NOx) storing model; and, determining the start of said second operating phase based on said (NOx) fill level (mnosp) of said NOx-storage catalytic converter.

7. A control apparatus for an internal combustion engine including an internal combustion engine of a motor vehicle, wherein the engine generates nitrogen oxides (NOx) and is switched back and forth by the control apparatus between a first operating phase wherein said nitrogen oxides (NOx) are stored in a nitrogen oxide (NOx)-storage catalytic converter and a second operating phase wherein the stored nitrogen oxides are discharged from the NOx-storage catalytic converter; and the control apparatus comprising:

first means for detecting a first value of an (NOx) mass flow (msnonk_s) rearward of said (NOx)-storage catalytic converter;

second means for taking a second value of said (NOx) mass flow (msnonk_m) rearward of said NOx-storage catalytic converter from an NOx storing model;

third means for forming a difference of said first and second values of said NOx mass flows (msnonk_m−msnonk_s);

fourth means for correcting said NOx storing model in dependence upon said difference (msnonk_m−msnonk_s);

fifth means for modeling an NOx fill level (mnosp) of said NOx-storage catalytic converter based on said (NOx) storing model; and, sixth means for determining the start of said second operating phase based on said (NOx) fill level (mnosp) of said NOx-storage catalytic converter.

8. An internal combustion engine including an internal combustion engine of a motor vehicle, the engine generating nitrogen oxides (NOx) and comprising:

a nitrogen oxide (NOx)-storage catalytic converter;

a control apparatus for switching said engine back and forth between a first operating phase wherein nitrogen oxides (NOx) are stored in said NOx-storage catalytic converter and a second operating phase wherein stored nitrogen oxides are discharged from said NOx-storage catalytic converter; and, said engine further including:

first means for detecting a first value of an (NOx) mass flow (msnonk_s) rearward of said (NOx)-storage catalytic converter;

second means for taking a second value of said (NOx) mass flow (msnonk_m) rearward of said NOx-storage catalytic converter from an NOx storing model;

third means for forming a difference of said first and second values of said NOx mass flows (msnonk_m−msnonk_s);

fourth means for correcting said NOx storing model in dependence upon said difference (msnonk_m−msnonk_s);

fifth means for modeling an (NOx) fill level (mnosp) of said NOx-storage catalytic converter based on said (NOx) storing model; and, sixth means for determining the start of said second operating phase based on said (NOx) fill level (mnosp) of said NOx-storage catalytic converter.

* * * * *

UNITED STATES PATENT AND TRADEMARK OFFICE

CERTIFICATE OF CORRECTION

PATENT NO. : 6,889,497 B2 
DATED : May 10, 2005
INVENTOR(S) : Eberhard Schnaibel and Klaus Winkler It is certified that error appears in the above-identified patent and that said Letters Patent is hereby corrected as shown below:

Column 7,
Line 5, delete “and” and insert -- and, -- therefor.
Line 45, insert -- (NOx) mass flow (msnonk_m) rearward of said -- before “NOx-storage”.
Line 49, delete “flow” and insert -- flows -- therefor.

Signed and Sealed this

Twelfth Day of July, 2005

JON W. DUDAS
*Director of the United States Patent and Trademark Office*